US011045816B2

(12) United States Patent
Albus

(10) Patent No.: US 11,045,816 B2
(45) Date of Patent: Jun. 29, 2021

(54) JET MILL

(71) Applicant: James F. Albus, Ormond Beach, FL (US)

(72) Inventor: James F. Albus, Ormond Beach, FL (US)

( * ) Notice: Subject to any disclaimer, the term of this patent is extended or adjusted under 35 U.S.C. 154(b) by 0 days.

(21) Appl. No.: 16/839,630

(22) Filed: Apr. 3, 2020

(65) Prior Publication Data

US 2020/0331001 A1 Oct. 22, 2020

Related U.S. Application Data

(60) Provisional application No. 62/829,352, filed on Apr. 4, 2019.

(51) Int. Cl.
*B02C 19/06* (2006.01)

(52) U.S. Cl.
CPC ..... *B02C 19/061* (2013.01)

(58) Field of Classification Search
CPC ..... B02C 19/06; B02C 19/063; B02C 19/061; B02C 19/065
See application file for complete search history.

(56) References Cited

U.S. PATENT DOCUMENTS 2,032,827 A * 3/1936 Andrews ..... B02C 19/061 241/5
2,588,945 A * 3/1952 Trost ..... B02C 19/061 241/39
2,763,437 A * 9/1956 Marchant ..... B02C 19/061 241/39
3,462,086 A * 8/1969 Bertrand ..... B02C 19/061 241/5
3,559,895 A * 2/1971 Fay ..... B02C 19/061 241/5
3,741,485 A * 6/1973 Gage ..... B02C 19/061 241/39
4,056,233 A * 11/1977 Fay ..... B02C 19/061 241/39
4,219,164 A * 8/1980 Taylor ..... B02C 19/061 241/5
4,280,664 A * 7/1981 Jackson ..... B02C 19/061 241/39
4,451,005 A * 5/1984 Urayama ..... B02C 19/061 241/152.1
4,502,641 A * 3/1985 Coombe ..... B02C 19/061 241/39
4,504,017 A 3/1985 Andrews
7,258,290 B2 * 8/2007 Taketomi ..... B02C 19/063 241/40

(Continued)

*Primary Examiner* — Adam J Eiseman
*Assistant Examiner* — Mohammed S. Alawadi
(74) *Attorney, Agent, or Firm* — Howson & Howson LLP

(57) ABSTRACT

In an axial jet mill, an internal structure having a cylindrical outer surface is positioned within a housing to establish a raceway for the circulating movement of gas and solid material while maintaining the gas and solid material in close proximity to the outlets of gas nozzles distributed around the perimeter of the raceway. Solid material enters the jet mill though a bottom wall of the housing and passes into the raceway though gaps between the bottom of the internal structure and a bottom wall of the housing. Particles and gas exit the jet mill though a central outlet in the housing located above the internal structure.

4 Claims, 1 Drawing Sheet

(56) References Cited

U.S. PATENT DOCUMENTS

| | | | | |
|---|---|---|---|---|
| 7,832,664 | B2 | 11/2010 | Albus | |
| 9,669,412 | B2 * | 6/2017 | Cattivelli | B02C 19/061 |
| 2005/0051649 | A1 * | 3/2005 | Taketomi | B02C 23/10 241/39 |
| 2008/0054106 | A1 * | 3/2008 | Zehavi | B02C 19/061 241/5 |
| 2019/0176161 | A1 * | 6/2019 | Beliavsky | B02C 19/061 |
| 2019/0291118 | A1 * | 9/2019 | Iamartino | B02C 19/06 |

* cited by examiner

JET MILL

CROSS-REFERENCE TO RELATED APPLICATION

This application claims the benefit, under 35 USC § 119(e), of U.S. Provisional Patent Application No. 62/829,352, filed Apr. 4, 2019.

FIELD OF THE INVENTION

This invention relates to jet mills for reducing the size of solid particles and particularly to improvements in so-called "axial" or "spiral" jet mills, i.e., jet mills in which gas jets distributed about the perimeter of a housing cause the solid particles to circulate within the housing about a central axis, and in which particles exit from the housing at a central location along the direction of the central axis.

BACKGROUND OF THE INVENTION

U.S. Pat. No. 2,032,827, granted on Mar. 3, 1936, describes a jet mill for pulverization and for providing material in finely divided form. The jet mill includes a housing having a circular, cylindrical, vertical wall with a multiplicity of angularly spaced nozzles arranged to release gaseous fluid at a high velocity in directions tangent to an imaginary cylinder located within the interior of the jet mill and coaxial with the cylindrical wall. The streams of gaseous fluid set up and maintain an inwardly spiralling vortex, and at the same time cut across and through the outer portion of the vortex, causing particles of material engaged by the streams of high velocity gaseous fluid to be hurled inward and into pulverizing impingement with other particles. Small particles are collected at a central location within the jet mill while larger particles continue to circulate.

Conventional axial jet mills, lack the ability to achieve efficient reduction of particles to the fine particle sizes required in modern pharmaceutical and biopharmaceutical products. In the case of larger diameter axial jet mills, the particles rapidly move inward to locations remote from the nozzles, where the kinetic energy of the gas streams exiting from the nozzles is insufficient to produce fine particles. Smaller diameter axial jet mills, on the other hand, can achieve better particle size reduction, but are less efficient because of their inability to process large volumes of material.

SUMMARY OF THE INVENTION

The jet mill in accordance with the invention comprises a housing, an internal structure within the housing for establishing an annular raceway for the flow of gas and particles of solid material, a plurality of nozzles for introducing gas into the raceway, an inlet passage for introduction of raw feed into the raceway, and an outlet passage for delivery of comminuted solid material out of the housing.

The housing has a top wall, a bottom wall, and an outer wall extending from the top wall to the bottom wall, thereby forming a closure. The outer wall has a substantially circular, cylindrical, inner surface uniformly spaced from a central axis.

The nozzles are disposed around the perimeter of the outer wall, and project jets of gas at high velocity inward through the outer wall. Each of the nozzles is arranged to project a jet of gas, e.g., air, in a direction on a side of the central axis such that the jets of gas projected by the nozzles can produce a unidirectional circulating flow of gas and particles in the raceway within the housing.

The internal structure has a substantially circular cylindrical outer surface coaxial with, spaced from, and opposed to, the inner surface of the outer wall of the housing. The diameter of the cylindrical outer surface of the internal structure is sufficiently large that the directions of the jets of fluid emitted by the nozzles intersect the cylindrical outer surface. The inner wall of the housing, and the outer surface of the internal structure, form boundaries of the annular raceway, which guides and confines the movement of circulating fluid and entrained particles of solid material. The internal structure limits inward movement of particles of solid material toward the central axis, and thereby increases the concentration of the particles of solid material in close proximity to the nozzles, where the kinetic energy of the gas streams is at its maximum.

The jets of gas hurl particles circulating in the raceway against one another, and also against the wall of the internal structure. Preferably, each of the nozzles is arranged to project a jet of fluid in a direction tangent to an imaginary cylinder, coaxial with, but having a diameter smaller than the diameter of, the cylindrical outer surface of the internal structure.

By carrying out all of the size reduction, i.e., grinding and micronization, in a circulating stream of gas and entrained particles within a raceway close to nozzles that continuously release jets of gas at high velocity, the particles are caused to collide with one another and with the wall of the internal structure with high kinetic energy, and with more effective and efficient size reduction than can be achieved with a conventional jet mill. The jet mill in accordance with the invention has the ability to achieve the fine particle distributions currently required for pharmaceutical and biopharmaceutical products that were heretofore possible only with low-efficiency, small diameter, axial jet mills.

In a preferred embodiment of the invention, the internal structure has a hollow interior space, and the inlet passage is arranged to deliver raw feed, consisting of solid material along with a material-carrying fluid, into the hollow interior space. From the hollow interior space, the raw feed passes through a gap between an edge of the internal structure and the bottom wall of the housing into the annular raceway. The gap can be configured so that the raw feed enters the raceway at substantially all locations along the length of inner boundary of the raceway, i.e., at all locations except at the locations of supporting structure connecting the internal structure to the bottom wall of the housing. Thus the raw feed can enter the raceway throughout substantially all of a 360° range, i.e., throughout substantially the entire length of the inner border of the raceway.

In the preferred embodiment, the internal structure also has a top surface below, and spaced from, the top wall of the housing. An outlet extends through the top wall of the housing, at a central location in the top wall. Particles ground in the raceway by the action of the jets of fluid move, through the space between top surface of the internal structure and the top wall of the housing and exit through the outlet.

DETAILED DESCRIPTION OF THE PREFERRED EMBODIMENTS

Figure 1:
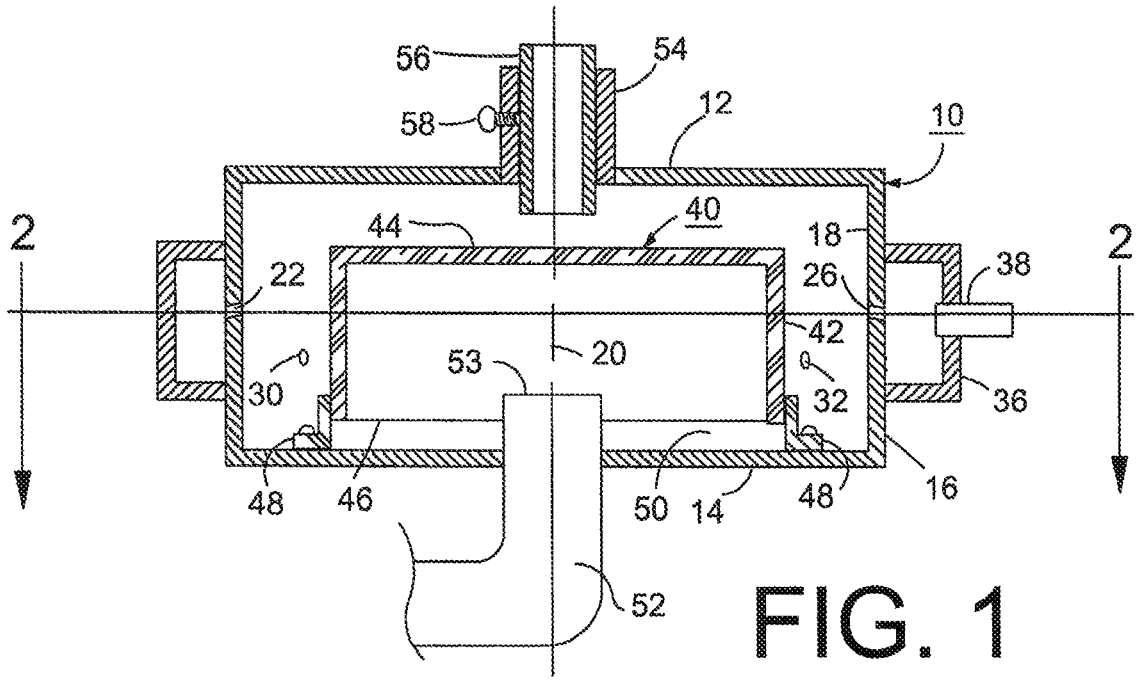
FIG. 1 is a vertical axial cross-sectional view of a jet mill in accordance with the invention.

As shown in the drawings, the jet mill in accordance with the invention includes a housing 10 having a top wall 12, a bottom wall 14 and a vertical outer wall 16 having a substantially circular, cylindrical inner surface 18 having a central axis 20, from which surface 18 is uniformly spaced. Typically the jet mill will be arranged so that the central axis is vertical. However the jet mill can be operated in other orientations. The wall 16 of the housing is provided with a set of openings distributed around its perimeter. These openings serve as nozzles for directing jets of gas into a raceway inside the housing. Four such openings, 22, 24, 26 and 28, are shown in FIG. 2. Openings 22 and 26 are also visible in FIG. 1. Openings 22, 24, 26 and 28 are at the same level. These nozzles are spaced at 90° intervals on the perimeter of vertical wall 16. Additional openings 30 and 32, located at a level below the level of openings 22-28 are visible in FIG. 1. Openings 30 and 32 are spaced from each other by a 90° interval, and are positioned at an angular spacing of 45° from openings 22 and 26. Two more such openings (not shown) at the same level as that of openings 30 and 32 are provided in wall 16, and are spaced at 90° intervals from openings 30 and 32. Thus, there is a total of eight openings, comprising four openings at each of two levels, in an arrangement such that the openings alternate from one level to the other and are spaced at angular intervals of 45°. Other arrangements of the openings can be utilized. For example jet mill can have eight openings all at the same level.

As seen in FIG. 2, openings 22, 24, 26 and 28 extend through wall 18 respectively on axes 23, 25, 27 and 29, that are tangent to an imaginary circular cylinder 34 coaxial with vertical axis 20. Openings 30 and 32, and the other two openings (not shown) at the same level, similarly extend though wall 18 on axes that are tangent to imaginary cylinder 34. With respect to a frame of reference for each opening, defined by a vertical plane in which the central axis 20 lies and which extends though the opening, the axis of each of the openings is directed toward the same side of the central axis 20, i.e., toward the right of the axis, so that jets of gas exiting from the openings produce a circulating flow within the housing that is counterclockwise when viewed from above as in FIG. 2. In alternative embodiments, the openings can be arranged to produce a clockwise flow.

Figure 2:
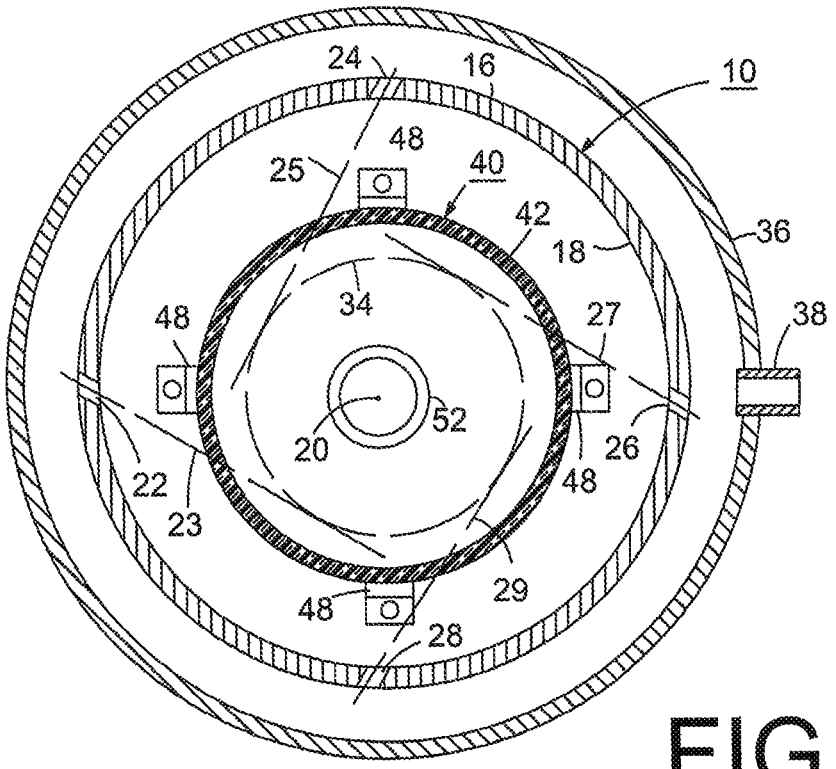
FIG. 2 is a horizontal section thereof, taken on section plane 2-2 in FIG. 1.

The axes of the openings can be directed obliquely upward as shown in FIG. 1. Alternatively, the axes of the openings can be horizontal or directed obliquely downward.

The part of wall 16 in which the openings are provided is surrounded by a circular manifold 36 into which a gas, e.g., air or superheated steam, is delivered under pressure though in inlet 38.

An internal structure 40, provided inside the housing 10, has a substantially circular, cylindrical outer surface 42, which is coaxial with the vertical central axis 20, uniformly spaced from the inner surface 18 of the housing wall 16, and opposed to the openings in wall 16 so that it is intersected by the axes of the openings. The diameter of the cylindrical outer surface 42 should be sufficiently large that the directions of the jets of fluid emitted by the nozzles intersect the cylindrical outer surface.

The internal structure is preferably composed of a ceramic material, e.g., alumina, which is substantially inert, less susceptible to deterioration than metal, and therefore more suitable for use in producing pharmaceutical products.

The internal structure 40 is preferably hollow, with a closed top wall 44 and a bottom opening 46. The structure is supported from the bottom wall on brackets 48, also preferably made of ceramic material, that maintain a space 50 between the lower edge of wall 42 and the bottom wall 14 of the housing. Solid material to be treated in the jet mill enters along with air or other carrying fluid through a channel 52, which extends upward through bottom wall 14 and into the interior of the internal structure, and has an outlet opening 53 in direct communication with the interior of the internal structure. The material then flows through space 50 underneath the wall 42 into the space between walls 42 and 16, which serves as the raceway for circulation of carrying gas and particles.

Particles are exposed to maximum kinetic energy because they are maintained in proximity to the gas jets, and they are reduced in size by collision with one another and by impact with the cylindrical wall 42 of the internal structure as they circulate at high velocity in the raceway. Smaller particles flow along with the carrying gas upward and over the top wall 44 of the internal structure, where they exit from the mill through a centrally located passage 54 extending vertically through top wall 12 of the housing. Passage 54 can be provided with a vertically adjustable tubular cylinder 56, for controlling flow through the outlet. The tubular cylinder can be secured at any desired height within a limited range by means of one or more thumbscrews, one of which is thumbscrew 58 in FIG. 1. Markings can be provided on the tubular cylinder to facilitate adjustment of the clearance between the lower end of cylinder 56 and the top wall 44 of the internal structure.

The clearance between the lower end of cylinder and the top wall of the internal structure affects the rate of flow of gas and particles from the raceway. With a smaller clearance, the rate of flow toward the outlet is reduced and inertia will maintain larger particles in the raceway so that only particles in a limited range of sizes escape the influence of inertia and pass through the outlet. If the clearance is enlarged by raising the cylinder 56, the rate of flow is increased, and the size range of the particles passing through the outlet increases.

The internal structure 40 maintains the circulating particles in close proximity to the jets of gas emitted through the jet nozzles in housing wall 16, thereby utilizing the kinetic energy of the gas jets more efficiently than current axial jet mills in which the particles are free to move radially inward toward a central location remote from the nozzles. For most effective grinding, the diameter of the outer wall of the internal structure, and the diameter of the inner surface of the outer wall of the housing are preferably such that the width of the raceway is approximately 6 cm. The jet mill in accordance with the invention can be made in various diameters and heights for different feed rates. In those jet mills having greater heights, i.e., jet mills in which the raceway has a large dimension in the direction of the central axis of the mill, the jet nozzles are preferably arranged at two or more levels to ensure rapid circulation of gas and entrained particles in all parts of the raceway.

Current designs, in which larger diameter jet mills can produce higher throughput rates, cannot produce fine particle sizes and fine particle size distributions that are possible with smaller diameter jet mills. The jet mill in accordance with the invention, however, because it incorporates a raceway grinding zone makes it possible to achieve fine article sizes and fine particle size distributions at much higher throughput rates.

Various modifications can be made to the apparatus described above. For example, the height of the internal structure can be increased or decreased, and, instead of mounting the internal structure from the bottom wall 14 of the housing on brackets, the bottom of the internal structure can be in direct contact with the bottom wall of the housing, and passages can be provided in the cylindrical side wall of the internal structure for movement of gas and particles into the raceway. The number and arrangement of nozzles can also be modified. For example, although in the embodiment described above the nozzles are constituted by openings though the outer wall of the housing alternative forms of nozzles can be utilized, e.g., special inserts that are replaceably fitted into openings in the outer wall, or nozzles that extend through openings in the outer wall, each nozzle being connected to a source of compressed air through a separate tube. These and other modifications can be made to the apparatus described without departing from the scope of the invention, which is defined in the following claims.

What is claimed is:

1. A jet mill comprising:

a housing having a top wall, a bottom wall, and an outer wall extending from the top wall to the bottom wall, thereby forming a closure, the outer wall having a circular, cylindrical inner surface uniformly spaced from a central axis;

a plurality of nozzles disposed around the perimeter of said outer wall for projecting jets of gas inward through said outer wall, each of said nozzles being arranged to project a jet of gas in a direction on a side of said central axis such that said jets can produce a unidirectional circulating flow of gas and particles of solid material within the housing;

an internal structure within the housing, said internal structure having a circular cylindrical outer surface coaxial with, spaced from, and opposed to, said inner surface of the outer wall of the housing, the diameter of the cylindrical outer surface being sufficiently large that the directions of the jets of fluid emitted by the nozzles intersect the cylindrical outer surface, and said cylindrical outer surface forming, with said circular, cylindrical inner surface of said outer wall of the housing, an annular raceway for guiding, and confining, said unidirectional circulating flow of gas and particles of solid material about said central axis, thereby limiting inward movement, and increasing concentration of, particles of solid material;

a channel for carrying the solid material to be treated in the jet mill, along with a material-carrying fluid, into the jet mill; and an outlet for movement of comminuted solid material from said annular raceway out of said housing;

in which said internal structure has a hollow interior space;

in which said channel has an outlet opening in direct communication with said hollow interior space, and is arranged to deliver said solid material to be treated along with said material-carrying fluid into said hollow interior space through said outlet opening, and in which said internal structure includes at least one passage adjacent said bottom wall of the housing, for movement of said solid material to be treated along with said material-carrying fluid from said hollow interior space into said annular raceway.

2. The jet mill according to claim 1, in which said at least one passage adjacent said bottom wall of the housing comprises a gap between said internal structure and said bottom wall of the housing.

3. The jet mill according to claim 1, in which said internal structure has a top surface below, and spaced from, the top wall of the housing, and in which said outlet comprises a passage extending through said top wall of the housing, at a central location in said top wall, whereby particles ground in said raceway by the action of said jets of gas directed by said nozzles, flow through the space between said top surface of the internal structure and the top wall of the housing and pass through said outlet.

4. The jet mill according to claim 1, in which each of said nozzles of said plurality of nozzles is arranged to project a jet of gas in a direction tangent to an imaginary circular cylinder coaxial with said cylindrical outer surface of said internal structure but having a diameter smaller than the diameter of said substantially cylindrical outer surface of said internal structure.

* * * * *